US008253082B2

(12) United States Patent
Sakai et al.

(10) Patent No.: US 8,253,082 B2
(45) Date of Patent: Aug. 28, 2012

(54) MAGNETRON DRIVING POWER SOURCE

(75) Inventors: Shinichi Sakai, Nara (JP); Nobuo Shirokawa, Nara (JP); Haruo Suenaga, Osaka (JP); Hideaki Moriya, Nara (JP); Manabu Kinoshita, Nara (JP)

(73) Assignee: Panasonic Corporation, Osaka (JP)

( * ) Notice: Subject to any disclaimer, the term of this patent is extended or adjusted under 35 U.S.C. 154(b) by 905 days.

(21) Appl. No.: 11/814,654

(22) PCT Filed: Jan. 20, 2006

(86) PCT No.: PCT/JP2006/300878

§ 371 (c)(1),
(2), (4) Date: Jul. 24, 2007

(87) PCT Pub. No.: WO2006/080258

PCT Pub. Date: Aug. 3, 2006

(65) Prior Publication Data

US 2009/0014442 A1 Jan. 15, 2009

(30) Foreign Application Priority Data

Jan. 25, 2005 (JP) ..... 2005-016458

(51) Int. Cl.
*H05B 6/66* (2006.01)
*H05B 6/68* (2006.01)

(52) U.S. Cl. ..... 219/715; 219/702; 219/716

(58) Field of Classification Search ..... 219/715–718, 219/737, 760, 639, 656, 702, 721; 315/39.51–39.57; 363/89, 97, 98; 323/277
See application file for complete search history.

(56) References Cited

U.S. PATENT DOCUMENTS

2003/0121913 A1* 7/2003 Hayami et al. ..... 219/730
2004/0074900 A1 4/2004 Suenaga et al.

FOREIGN PATENT DOCUMENTS

| | | | |
|---|---|---|---|
| EP | 0-239-072 A | | 9/1987 |
| JP | 05-047467 | | 2/1993 |
| JP | 08-227790 | | 9/1996 |
| JP | 08227790 A | * | 9/1996 |
| JP | 11-144860 | | 5/1999 |
| JP | 11144860 A | * | 5/1999 |
| JP | 2004-006384 | | 1/2004 |
| JP | 2006-100012 | | 4/2006 |

OTHER PUBLICATIONS

Supplementary European Search Report.

* cited by examiner

*Primary Examiner* — Henry Yuen
*Assistant Examiner* — Hung D Nguyen
(74) *Attorney, Agent, or Firm* — Pearne & Gordon LLP

(57) ABSTRACT

A magnetron driving power source can detect the abnormal condition during no-load running with low cost and space saving. The magnetron driving power source includes a high voltage transformer (12) for supplying a high voltage to a magnetron (11), a switching part (13) for driving the high voltage transformer at a high frequency, a first control part (14) for giving a drive signal to the switching part, a second control part (16) for issuing an output command to the first control part, and a third control part (19) for correcting the output command in accordance with a decrease in the oscillation threshold value of the magnetron, wherein the first control part (14) performs a power down control in accordance with a signal from the third control part. Accordingly, the magnetron driving power source of the invention can treat the signal on the control side of the inverter and detect the abnormal condition during no-load running with low cost and space saving.

4 Claims, 5 Drawing Sheets

MAGNETRON DRIVING POWER SOURCE

TECHNICAL FIELD

The present invention relates to a magnetron driving power source of an inverter control method for use in a microwave oven or the like to make the power control during abnormal operation such as no-load running.

PRIOR ART

Conventionally, the magnetron driving power source of this type comprises a current transformer for measuring the secondary-side current to detect an abnormal condition during abnormal operation such as no-load running (e.g., refer to patent document 1).

FIG. 8 shows the conventional magnetron driving power source as described in patent document 1. The magnetron driving power source comprises a magnetron 1, a high voltage transformer 2, a switching part 3, a control part 4, a current transformer 5 for detecting the input current, and a current transformer 6 for detecting the secondary-side current, as shown in FIG. 8.

[Patent document 1] JP-A-5-47467

DISCLOSURE OF INVENTION

Problems that the Invention is to Solve

However, in the conventional constitution, the magnetron driving power source comprises the current transformer 5 for detecting the primary-side current precisely to produce a high output within the indoor wiring capacity, and the current transformer 6 on the secondary side for detecting the abnormal condition during no-load running. Therefore, insulation means such as the current transformer 6 or a photo-coupler is required to overcome a difference in the potential between the primary and secondary sides, resulting in a problem with the additional cost for detecting the abnormal condition and a problem with the packaging space for parts in reducing the size of the power source.

This invention has been achieved to solve the above-mentioned problems associated with the prior art, and it is an object of the invention to provide a magnetron driving power source that can detect the abnormal condition during no-load running on the primary side with low cost and space saving.

Means for Solving the Problems

In order to accomplish the above object, the present invention provides a magnetron driving power source comprising a magnetron for supplying a microwave, a high voltage transformer for supplying a high voltage to the magnetron, a switching part for driving the high voltage transformer at a high frequency, a first control part for giving a drive signal to the switching part, a second control part for issuing an output command to the first control part, and a third control part for correcting the output command in accordance with a decrease in the oscillation threshold value of the magnetron, wherein the first control part performs a power down control in accordance with a signal from the third control part.

Thereby, the oscillation threshold voltage decreases due to a lower magnetic field because the temperature of a magnet of the magnetron rises in the abnormal condition during no-load running. Since the high voltage transformer has a fixed voltage up ratio, the primary-side voltage of the high voltage transformer correspondingly decreases. This decreased voltage is used as a control element, whereby the power down control can be made in the abnormal condition during no-load running.

Also, the invention provides the magnetron driving power source wherein a partial voltage of the collector-emitter voltage in the switching element of the switching part that is the control element of the third control part and a reference signal from the second control part are connected by a diode or a transistor and inputted into the first control means to make the power down.

Thereby, the reference voltage from the second control part for making the normal power control and the partial voltage of the collector-emitter voltage in the switching element of the switching part that is the control element of the third control part, the collector-emitter voltage being decreased when the primary-side voltage of the high voltage transformer decreases in the abnormal condition during no-load running, are connected by the diode or the PN junction of transistor, whereby the third control part is given priority over the second control part for making the normal power control during excessive no-load running, so that the power down can be autonomously made to enable the autonomous protection of the device.

Also, the invention provides the magnetron driving power source, wherein the partial voltage of the collector-emitter voltage in the switching element of the switching part that is the control element of the third control part is varied in voltage in accordance with the reference voltage of the second control part.

Thereby, the power control with high S/N ratio for the abnormal operation can be effected during the power control that is a feature of the magnetron driving power source of the switching drive type.

Effect of the Invention

The magnetron driving power source of the invention can treat the signal on the control side of the inverter and detect the abnormal condition during no-load running with low cost and space saving.

DESCRIPTION OF REFERENCE NUMERALS AND SIGNS

Figure 1:
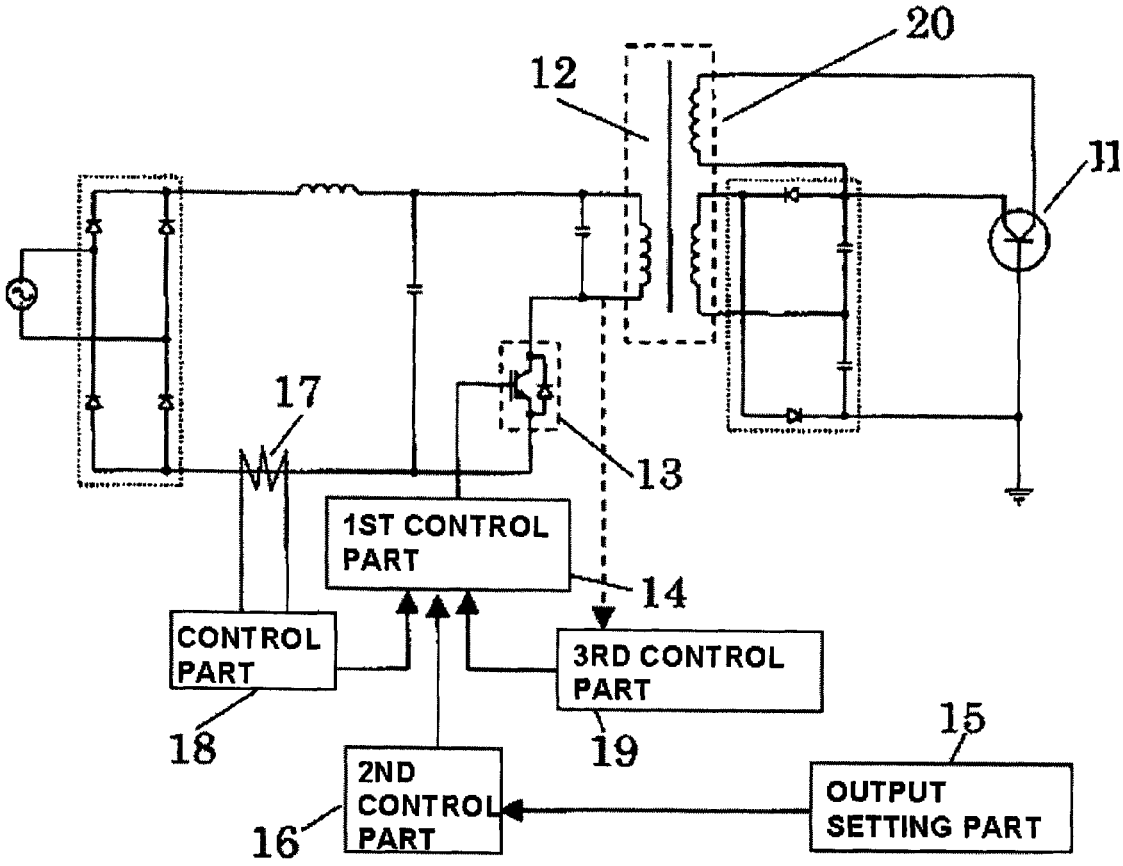
FIG. 1 is a block diagram showing a control circuit for a magnetron driving power source according to a first embodiment of the present invention.

11 magnetron
12 high voltage transformer
13 switching part
14 first control part
16 second control part
19 third control part

BEST MODE FOR CARRYING OUT THE INVENTION

A first invention is a magnetron driving power source comprising a magnetron for supplying a microwave, a high voltage transformer for supplying a high voltage to the magnetron, a switching part for driving the high voltage transformer at a high frequency, a first control part for giving a drive signal to the switching part, a second control part for issuing an output command to the first control part, and a third control part for correcting the output command in accordance with a decrease in the oscillation threshold value of the magnetron, wherein the first control part performs a power down control in accordance with a signal from the third control part. Accordingly, it is possible to detect on the primary side of the high voltage transformer that the oscillation threshold of the magnetron decreases during abnormal operation such as no-load running to make the power down using the signal, and detect the abnormal condition during no-load running with low cost and space saving.

A second invention is the magnetron driving power source according to the first invention, wherein the basic power control is performed based on an input current flowing through the primary side of the high voltage transformer. Accordingly, it is possible to detect the abnormal condition during no-load running without current detection means on the secondary side and effect the low cost and space saving.

A third invention is the magnetron driving power source according to the first or second invention, wherein a control element of the third control part proportional to a decrease in the oscillation threshold value of the magnetron is a control element proportional to a collector-emitter voltage in a switching element of the switching part. Accordingly, it is possible to detect, based on the partial voltage between collector and emitter in the switching element of the switching part, that the oscillation threshold of the magnetron decreases during abnormal operation such as no-load running to make the power down using the signal, and detect the abnormal condition during no-load running with low cost and space saving.

A fourth invention is the magnetron driving power source according to the third invention, wherein a partial voltage of the collector-emitter voltage in the switching element of the switching part that is the control element of the third control part and a reference signal from the second control part are connected by a diode or a transistor and inputted into the first control means to make the power down. Accordingly, the power down can be made only during abnormal operation, but not more than necessary.

A fifth invention is the magnetron driving power source according to the third or fourth invention, wherein the partial voltage of the collector-emitter voltage in the switching element of the switching part that is the control element of the third control part is varied in voltage in accordance with the reference voltage of the second control part. Accordingly, the power control with high S/N ratio for the abnormal operation can be effected during the power control that is a feature of the magnetron driving power source of the switching drive type by varying the control element of the third control part in accordance with the reference voltage of the second control part.

The embodiments of the present invention will be described below with reference to the drawings. The invention is not limited by these embodiments.

Embodiment 1

FIG. 1 is a block diagram showing a control circuit for a magnetron driving power source according to a first embodiment of the present invention.

Figure 2:
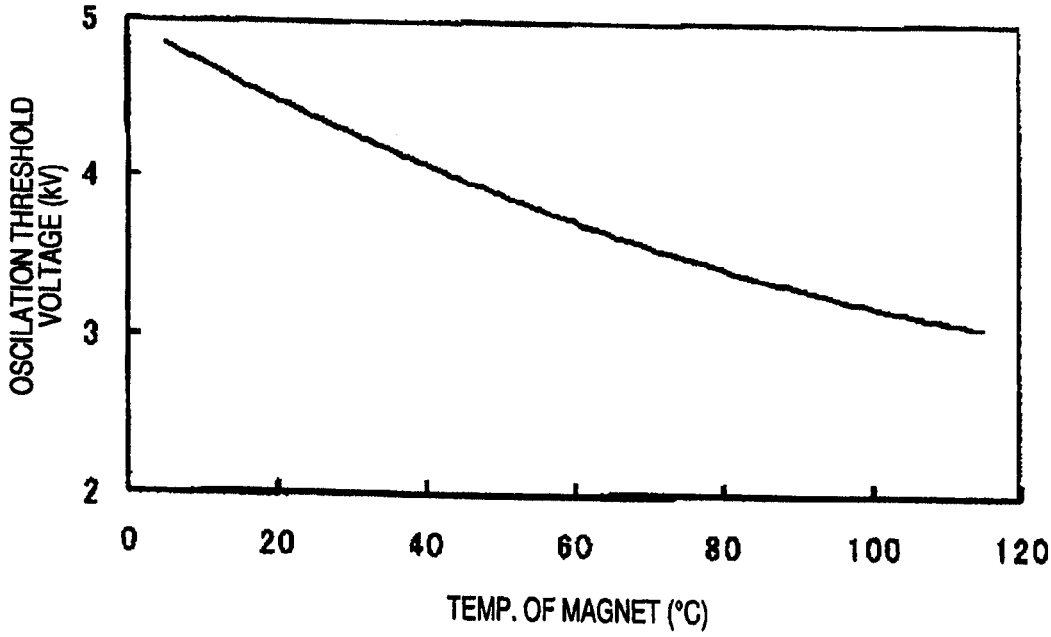
FIG. 2 is a graph for explaining the temperature dependency of a magnetron oscillation threshold voltage with the magnetron driving power source according to the first embodiment of the invention.

FIG. 2 is a graph for explaining the temperature dependency of a magnetron oscillation threshold voltage with the magnetron driving power source according to the first embodiment of the invention.

In FIG. 1, a magnetron 11 supplies a microwave to a heating chamber, not shown. The magnetron 11 starts the oscillation when a voltage increased by a high voltage transformer 12 exceeds an oscillation threshold voltage as shown in FIG. 2. On the primary side of the high voltage transformer, a voltage required for magnetron oscillation is generated by a voltage oscillation with a switching part 13. The generated voltage is power controlled by a first control part 14 to produce an output set by an output setting part 15. To produce the output set by the output setting part 15, a signal detected by a current detection part 17 is integrated by a control part 18 to have a reference voltage of a second control part 16 proportional to it, and power controlled by the first control part 14 to be equivalent. The first control part 14 can correct the output with a control element of a third control part 19.

The operation and action of the magnetron driving power source as constituted above will be described below.

First of all, the operation principle of the magnetron 11 for generating the microwave has a characteristic that the cathode is heated by a filament winding 20 of the high voltage transformer 12, and at the same time the potential increased by the high voltage transformer 12 exceeds an oscillation threshold voltage of the magnetron 11, so that electrons are discharged from the cathode to the anode to oscillate with a cavity resonator. For the cavity resonation, the action of a magnetic field with a magnet provided for the magnetron 11 is required. The magnet has a temperature characteristic, or a characteristic that as the temperature of the magnet rises, the oscillation threshold voltage decreases, as shown in FIG. 2.

If the no-load running is performed, the energy returns to the magnetron 11 because there is no substance for absorbing electromagnetic wave within a heating chamber, causing an abnormal heating of the magnetron 11 to lead to shorter life of parts or damage of parts, and increasing the temperature of each part of the magnetron such as the magnet at the same time.

To prevent this, this invention makes use of a phenomenon that the oscillation threshold voltage of the magnetron 11 rapidly decreases during non-load running. That is, there is a characteristic that if the oscillation threshold voltage of the magnetron 11 decreases, the output voltage of the high voltage transformer 12 also decreases, whereby the primary voltage of the high voltage transformer 12 with a fixed voltage up ratio also decreases.

On the other hand, in the normal power control, a reference voltage equivalent to the output power value set by the output setting part 15 is set by the second control part 16. The switching part 13 is controlled in the first control part 14 so that the integration of a signal from the current detection part 17 through the control part 18 may be consistent with the set reference voltage.

Herein, if there occurs an abnormal condition such as no-load running, the primary voltage of the high voltage transformer 12 decreases, as previously described, whereby a control element based on it is outputted in the third control part 19. If it is lower than the reference voltage of the second control part 16, a signal produced in the third control part 19 is made the reference voltage to decrease the output power, protecting the magnetron against overheat.

Also, the location of the current detection part can be freely set. However, if the input current is detection object, as shown in FIG. 1, this function effectively works. In the case of input current control, the power on the input side is kept constant, and (oscillation threshold voltage)×(secondary current) is the output power on the secondary side. In view of a power conservation principle, the secondary current rapidly increases to deteriorate the parts such as the magnetron during the no-load running.

As described above, in this embodiment, for a decrease in the oscillation threshold voltage of the magnetron, the output power can be decreased during the abnormal operation such as no-load running by using the output of the third control part provided on the primary side of the high voltage transformer instead of the reference voltage, whereby the protection of parts such as the magnetron can be realized with low cost and space saving.

Also, if the current detection location of this embodiment is the input current part on the primary side, it is possible to effectively prevent the current from increasing, especially when the secondary current is abnormal, achieving a great effect of protection.

Embodiment 2

Figure 3:
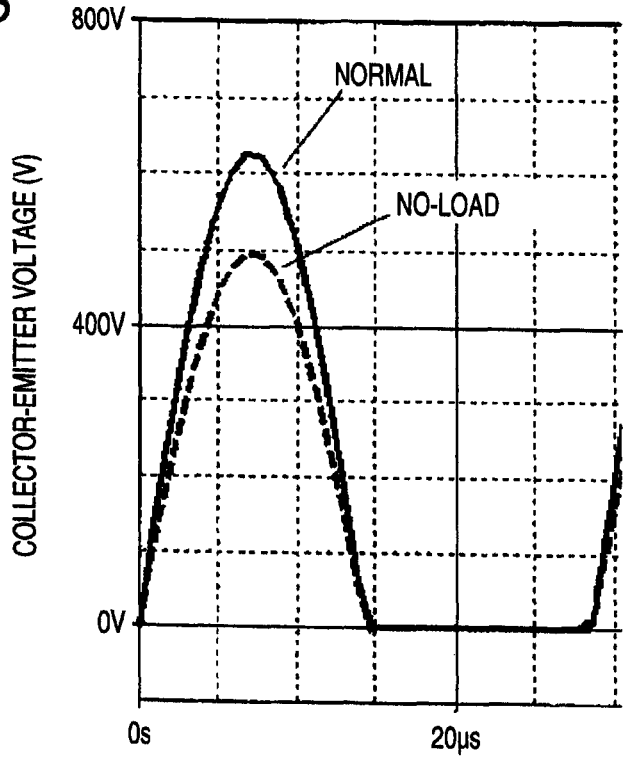
FIG. 3 is a view showing the change of collector-emitter voltage with a magnetron driving power source according to a second embodiment of the invention.

FIG. 3 is a view showing the change of collector-emitter voltage with a magnetron driving power source according to a second embodiment of the invention.

Figure 4:
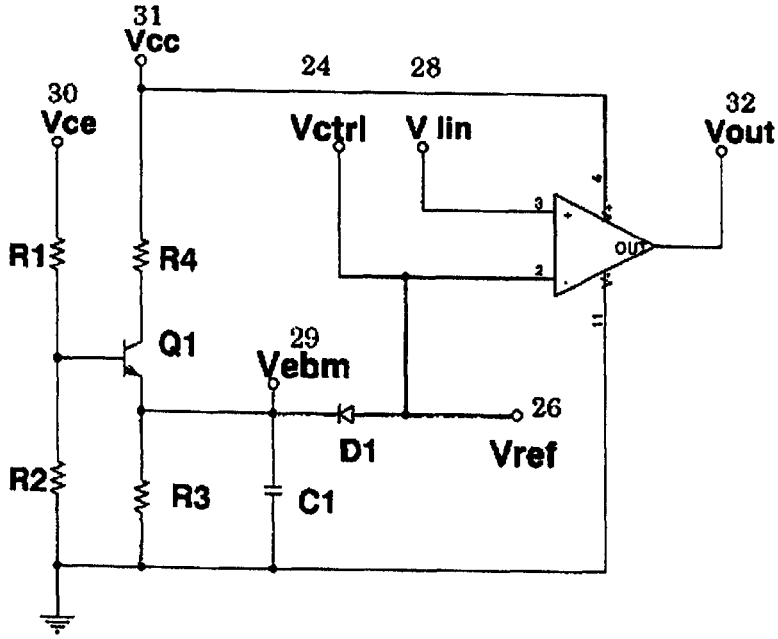
FIG. 4 is a circuit diagram of the essence for the magnetron driving power source according to the second embodiment of the invention.

Also, FIG. 4 is a circuit diagram of the essence for the magnetron driving power source according to the second embodiment of the invention.

Figure 5:
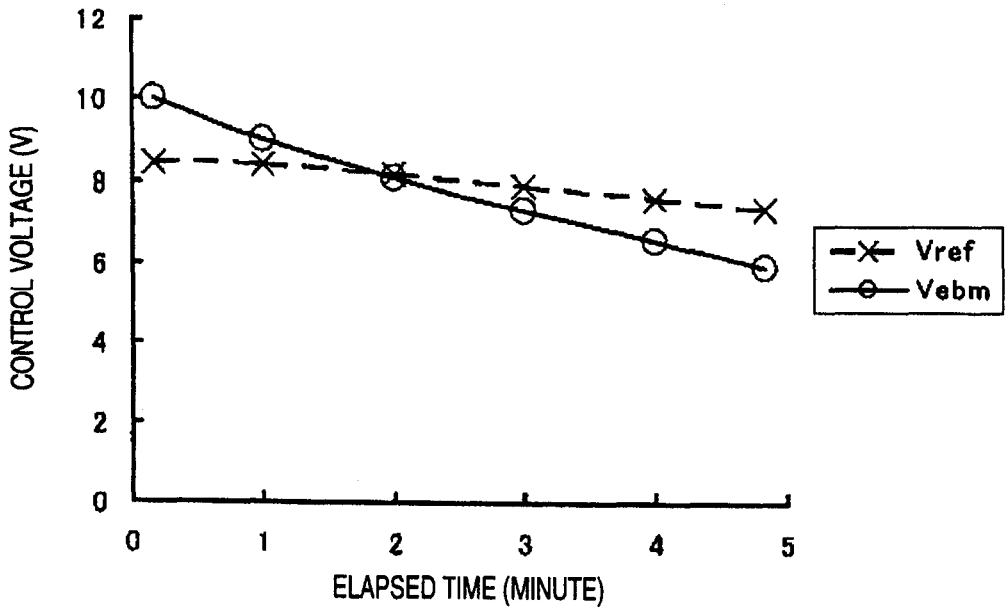
FIG. 5 is a view showing the change of control voltage of each part over time during no-load running with the magnetron driving power source according to the second embodiment of the invention.

Also, FIG. 5 is a view showing the change of control voltage of each part over time during no-load running with the magnetron driving power source according to the second embodiment of the invention.

In FIG. 4, Vref 26 is an output control voltage of the second control part 16, which is connected with Vebm 29, or the output of the third control part 19, via a diode D1. Also, Vce 30 is a collector-emitter voltage in the switching element of the switching part 13 on the primary side of the high voltage transformer 12 proportional to the oscillation threshold voltage of the magnetron 11. And Vctrl 24 is the first control part 14, and compared with VIin 28, or the output of the control part 18, to control the switching part 13 based on its result. Vcc 31 is a control voltage of the control part.

The operation and action of the magnetron driving power source as constituted above will be described below.

First of all, the operation principle of the magnetron 11 has a characteristic that if the oscillation threshold voltage of the magnetron 11 rapidly decreases, the output voltage of the high voltage transformer 12 also decreases, and the primary-side voltage of the high voltage transformer 12 with a fixed voltage up ratio also decreases. As a result, the collector-emitter voltage Vce 30 in the switching element of the switching part 13 has a lower peak voltage during no-load running than during normal running, as shown in FIG. 3.

To make effective use of this characteristic, the collector-emitter voltage Vce 30 in the switching element of the switching part 13 is divided by resistors R1 and R2, and the resistor divided voltage is passed through a transistor Q1, and then integrated by R3 and C1 to have the output voltage Vebm 29 of the third control part 19, as shown in FIG. 4.

On the other hand, in the normal power control, the reference voltage Vref 26 equivalent to the output power set by the output setting part 15 is set by the second control part 16.

Vebm 29 and Vref 26 are connected via the diode D1. With the connected output signal voltage Vctrl 24 of the first control part 14, in the abnormal condition such as during no-load running, Vebm 29 is lower than Vref 26, the control object is changed from Vref 26 of the control object in the normal condition, and the power down is made to protect the parts such as the magnetron.

FIG. 5 shows the behavior of the control voltage of each part during no-load running with the actual full power. In this case, Vebm is lower than Vref after about two minutes, and the power down is made.

As described above, in this embodiment, the output power can be decreased in the abnormal condition such as during no-load running by connecting Vebm and Vref via the diode, whereby the protection of parts such as the magnetron can be realized with low cost and space saving.

In this embodiment, Q1 in FIG. 4 may be replaced with a diode, or D1 may be replaced with a transistor, whereby the same effect can be achieved.

Embodiment 3

Figure 6:
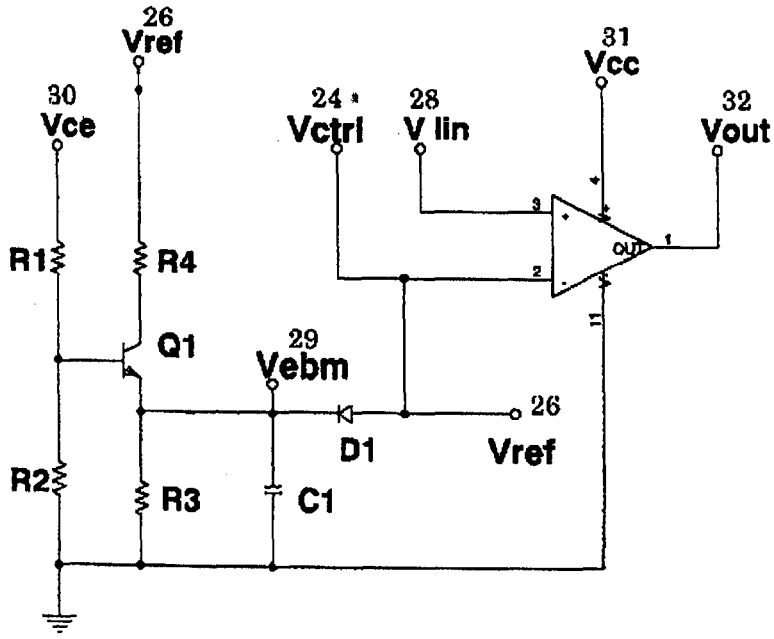
FIG. 6 is a circuit diagram of the essence for a magnetron driving power source according to a third embodiment of the invention.

FIG. 6 is a circuit diagram of the essence for a magnetron driving power source according to a third embodiment of the invention.

Figure 7:
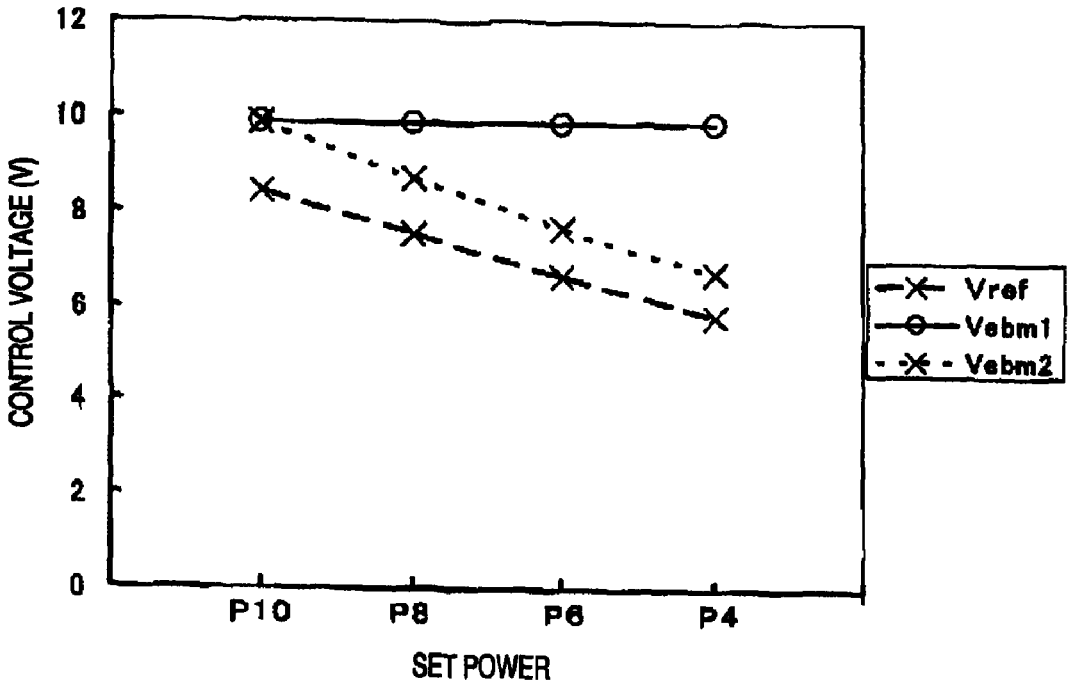
FIG. 7 is a graph showing the behavior of each control voltage in switching the output power of the magnetron driving power source according to the third embodiment of the invention.
Figure 8:
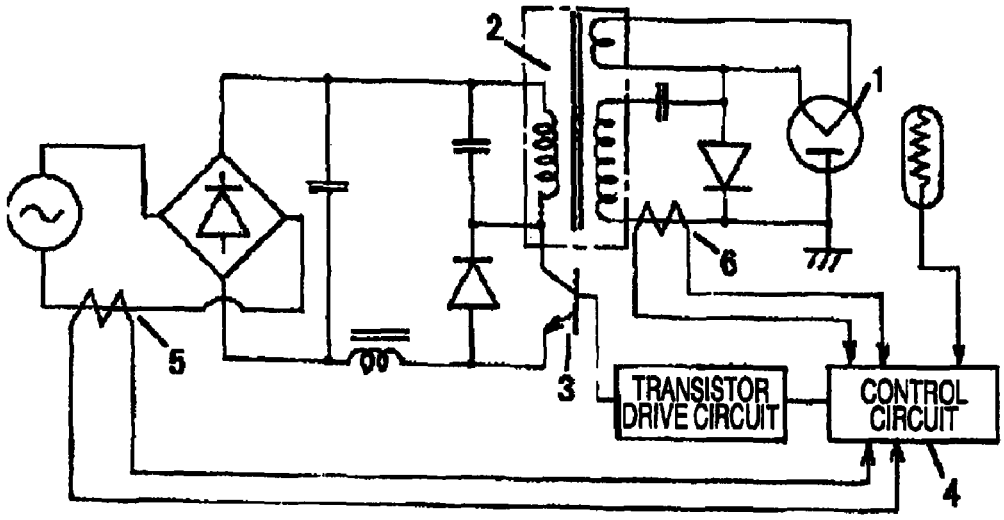
FIG. 8 PRIOR ART
FIG. 8 is a block diagram of a control circuit for the conventional magnetron driving power source.

Also, FIG. 7 is a graph showing the behavior of each control voltage in switching the output power of the magnetron driving power source according to the third embodiment of the invention. Herein, the control voltage decreases from output power P10 to P4.

In the configuration of FIG. 6, the bias voltage of Q1 is changed from Vcc 31 in FIG. 4 to Vref 26.

In FIG. 7, Vebm 1 shows an output voltage example of Vebm 29 in the embodiment 2, and Vebm 2 shows an output voltage example of Vebm 29 in the embodiment 3.

The operation and action of the magnetron driving power source as constituted above will be described below.

First of all, as shown in FIG. 7, the output voltage Vebm 29 of the third control part 19 is constant like Vebm 1 as shown in FIG. 7, although the output power is switched in the second embodiment of the invention. However, the bias voltage of Q1 is changed from Vcc 31 to Vref 26, so that Vebm 29 can be obtained, following the change of Vref 26 in accordance with the output power.

As described above, in this embodiment, the bias voltage of the transistor in the control part for Vebm is changed from the control voltage of the control circuit to the voltage of Vref following the change of the output voltage, so that Vebm can be obtained following the change of Vref in accordance with the output power, whereby the S/N ratio of abnormal protection can be improved.

While this invention has been described above in detail in connection with specific embodiments, it will be apparent to those skilled in the art that various changes or modifications may be made thereto without departing from the scope or spirit of the invention. This application is based on Japanese Patent Application No. 2005-016458, filed Jan. 25, 2005, the contents of which are incorporated herein by reference.

INDUSTRIAL APPLICABILITY

As described above, the magnetron driving power source according to the invention can detect the abnormal condition such as during no-load running with low cost and space saving by treating the signal on the control side of the inverter, and can be applied in the uses with low cost but high reliability and needing size reduction.

The invention claimed is:

1. A magnetron driving power source comprising:

a magnetron for supplying a microwave;

a high voltage transformer for supplying a high voltage to said magnetron;

a switching part for driving said high voltage transformer at a high frequency;

a sensor for transmitting a sensor signal indicative of a current through a primary side of said high voltage transformer;

a first control part for giving a drive signal to said switching part;

a second control part for issuing an output command to said first control part for comparison by said first control part to said sensor signal, wherein said drive signal transmitted by said first control part is determined based on a result of said comparison of said sensor signal to said output command; and a third control part for transmitting a correction signal to said first control part for correcting the output command to be compared to said sensor signal in response to a decrease in an oscillation threshold value of said magnetron;

wherein said first control part is adapted to generate the drive signal by comparing the sensor signal to a reference signal which is a control element of said third control part or the output command, and performs a power down control by using the control element of said third control part as reference signal when the control element of said third control part is lower than the output command; and wherein said control signal transmitted by said third control part is proportional to a collector-emitter voltage in a switching element of said switching part.

2. The magnetron driving power source according to claim 1, wherein normal power control is performed based on said current flowing through the primary side of said high voltage transformer.

3. The magnetron driving power source according to claim 1, wherein a partial voltage of the collector-emitter voltage in the switching element of said switching part that is the control element of said third control part and a reference signal from said second control part are connected by a diode or a transistor and inputted into said first control means to make the power down.

4. The magnetron driving power source according to claim 1, wherein the partial voltage of the collector-emitter voltage in the switching element of said switching part that is the control element of said third control part is varied in voltage in accordance with the reference voltage of said second control part.

* * * * *